114-253. XR 3,953,905 SR

TX 114/253

United S

Paitson

[11] 3,953,905

[45] May 4, 1976

[54] STABILIZED, TOWABLE SPAR BUOY

[75] Inventor: John Lloyd Paitson, Houston, Tex.

[73] Assignee: Western Geophysical Company of America, Houston, Tex.

[22] Filed: July 15, 1974

[21] Appl. No.: 488,368

[52] U.S. Cl. ..... 9/8.3 E; 9/8 R; 114/235 B

[51] Int. Cl.[2] ..... B63B 21/52

[58] Field of Search ..... 9/8 R, 8.3 R, 8.3 E; 114/235 B

[56] References Cited

UNITED STATES PATENTS

| | | | |
|---|---|---|---|
| 2,404,681 | 7/1946 | Baack | 9/8.3 E |
| 2,448,713 | 9/1948 | Hansell | 9/8 R |
| 3,062,171 | 11/1962 | Somerville | 114/235 B |
| 3,398,715 | 8/1968 | Burg | 114/235 B |
| 3,469,551 | 9/1969 | LeFebvre | 9/8 R |
| 3,500,209 | 3/1970 | Fletcher et al. | 9/8 R |

FOREIGN PATENTS OR APPLICATIONS

| | | | |
|---|---|---|---|
| 1,506,340 | 2/1970 | Germany | 9/8.3 E |
| 652,039 | 4/1951 | United Kingdom | 9/8.3 E |

*Primary Examiner*—Trygve M. Blix
*Assistant Examiner*—Edward R. Kazenske
*Attorney, Agent, or Firm*—Michael P. Breston; William A. Knox

[57] ABSTRACT

A spar buoy is dynamically stabilized by providing a streamlined, V-shaped wing just above the center of gravity of the spar. The wing has a dihedral sufficient to stabilize the spar in three axes while under tow. The buoy may be equipped with a radio transmitter and a flasher beacon for tracking by an automatic direction finder.

9 Claims, 6 Drawing Figures

STABILIZED, TOWABLE SPAR BUOY

BACKGROUND OF THE INVENTION

In marine seismic exploration, a ship tows a powerful sound source and a streamer cable including arrays of hydrophones. At intervals along the survey line, the sound source generates acoustic waves which propagate through the water and into the underlying earth layers. The acoustic waves become reflected from the earth layers and return to the water surface where the acoustic waves are detected by the hydrophones. The hydrophones convert the acoustic waves to electrical signals which are transmitted through a multiconductor cable to a signal recording device on the ship. The streamer has a neutral or slightly positive buoyance. Typically, a streamer may be up to two miles long, contain a thousand or more hydrophones and 100 pairs of electrical conductors. A serious financial loss results when a portion of the streamer becomes severed from the tow.

It is customary to attach to the end of the streamer a tail buoy usually provided with a radio transmitter, a high-intensity flashing light beacon and even a radar reflector. By use of a direction finder and/or visual sighting of the beacon, a severed buoy can be located and then recovered. Also, since strong oceanic cross currents may sweep the far end of the very long streamer off the desired survey line, the direction finder can provide a continuous means to measure the off course deviation of the streamer's remote end.

Various types of tail buoys have been used in the past, including sleds, catamarans, can buoys, discus buoys, spar buoys, spherical rubber buoys, and wooden rafts. The desiderata for a suitable tail buoy are: it must be stable under tow at speeds of 6 to 10 knots: it must provide means to elevate and support a flasher, radio antenna, and radar reflector well above the water level; it should present minimal drag to the towing ship; it should generate minimal acoustic noise; it must be compact, light and yet sufficiently rugged to withstand rough seas, and it must be self righting.

Although sleds, catamarans, discus buoys and rafts are capable of supporting a mast for the radio and flasher, they are relatively heavy, bulky and sometimes capsize in heavy seas and fail to right themselves. Cylindrical can buoys and spherical rubber buoys are unsuitable for supporting a mast because the vertical axis is unstable unless a keel is added; but a keel adds weight, bulk, and generates undesirable noise and creates considerable towing drag.

Conventional spar buoys are satisfactory from the standpoint of weight and compactness, but they are unstable when under tow.

It is therefore an object of this invention to provide a light, compact, and rugged tail buoy which is stable, presents minimal drag, and generates minimal acoustic noise when under tow.

SUMMARY OF THE INVENTION

A spar buoy is provided with stabilizing means including a V-shaped wing having an optimum dihedral angle sufficient to stabilize the spar buoy in the pitch, roll and yaw axes. A bridle is coupled to the wing and to the bottom of the spar in a manner as to produce for the wing a positive angle of attack. The preferred dihedral angle is 30° relative to the horizontal. An antenna and beacon are positioned on the upper end of the spar and the transmitter and batteries are mounted near the bottom of the spar for ballast. Tilt switches can be provided in each vertical axis to turn off the battery power if and when the spar inclines more than 60° from the vertical.

DETAILED DESCRIPTION OF THE INVENTION

Figure 1:
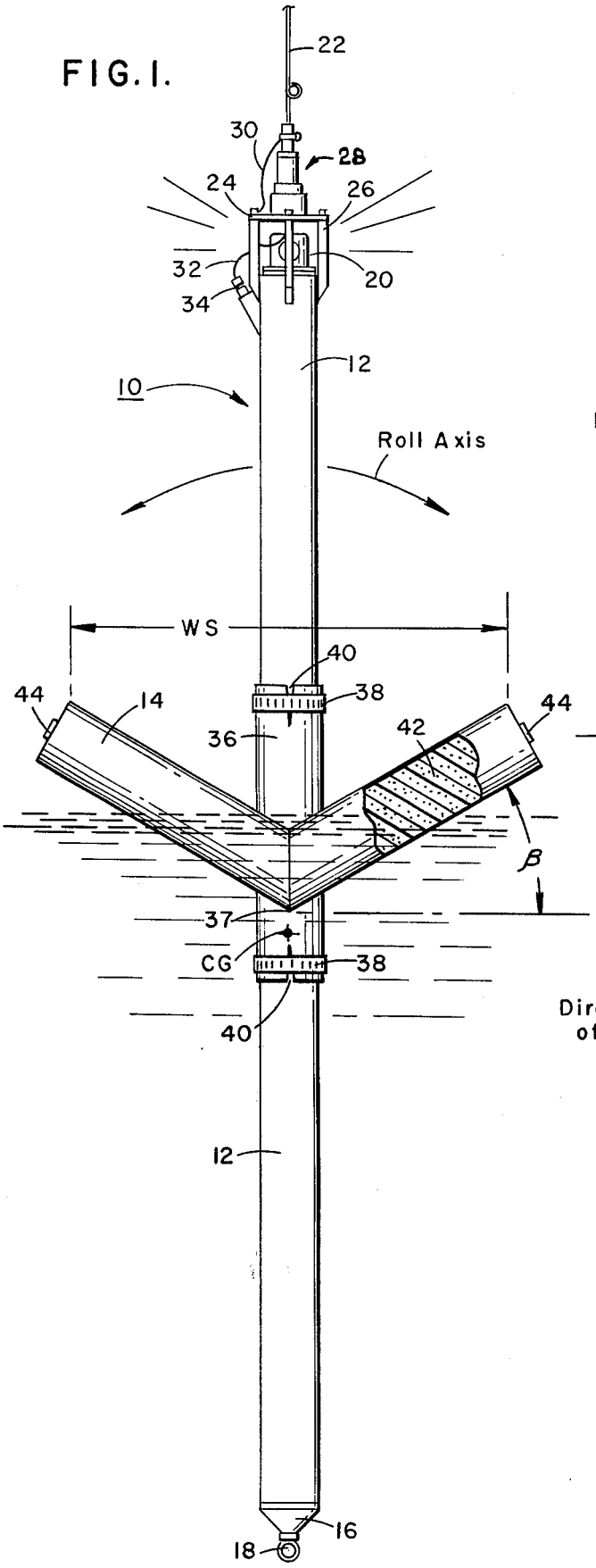
FIG. 1 is an overall front view of the tail buoy.
Figure 2:
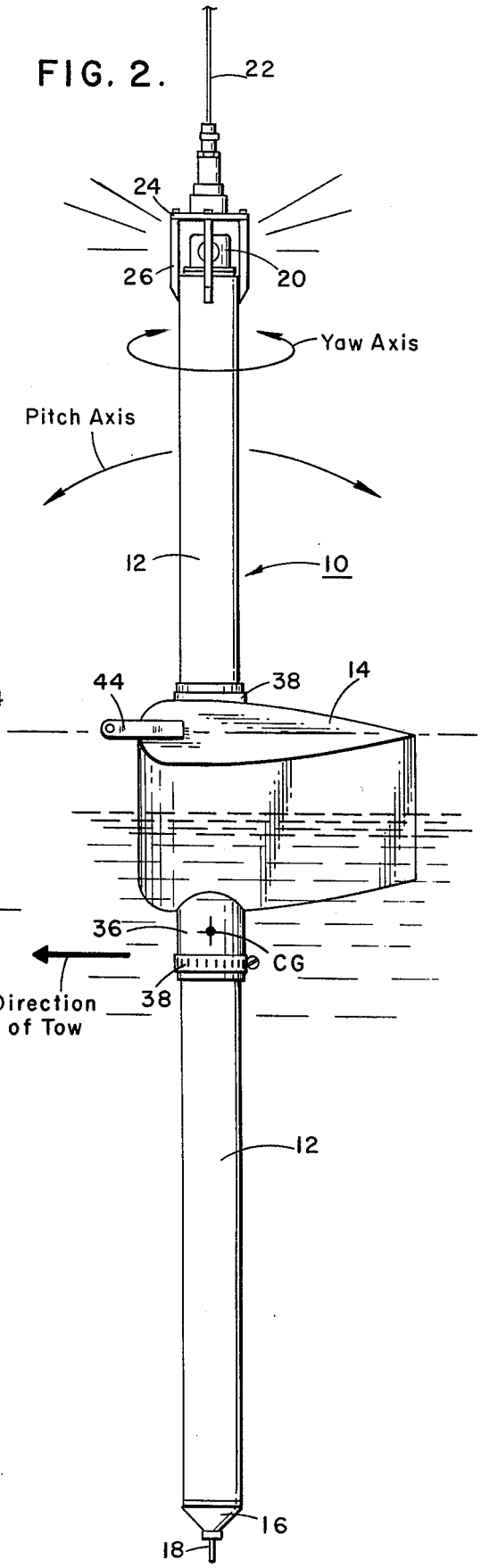
FIG. 2 is a side view of the tail buoy.

Referring now to the drawings and particularly to FIGS. 1 and 2, there is shown a tail buoy, generally designated as 10. Buoy 10 consists of a buoyant hollow aluminum spar 12, a bouyant streamlined hollow V-wing 14, and an end plug 16 to which is attached a towing eye 18. Signalling means including a high-intensity flasher housing 20 and a transmitter antenna 22 are mounted at the top of buoy 10.

Antenna 22 is supported by a baseplate 24 which is fastened to the top of spar 12 by four mounting bolts 26, of which three are shown. The antenna shield 28 is grounded to a bolt 26 by a short lead 30. Radio signals are fed to antenna 22 by shielded lead 32 which exits spar 12 through waterproof fitting 34 and is connected to a transmitter as will be described hereinafter.

Wing 14 is pierced by and welded to a casing 36 having split ends as at 40. Casing 36 is located midway between the ends of wing 14, near the leading edge thereof to position the spar well forward of the wing's center of drag. In use, spar 12 is inserted through casing 36 until the apex 37 of V-shaped fin 14 is a few inches above the center of gravity (CG) of spar 12. Casing 36 is then clamped to spar 12 by compressing the split ends 40, using clamps 38 which may be stainless steel hose clamps of a suitable size.

Wing 14 is constructed of sheet aluminum and is filled with a light, plastic foam material 42 to preserve the wing's buoyancy in case of puncture, by preventing water invasion. Towing eyes 44 are welded to the ends of wing 14. In a preferred embodiment, spar 12 is 10 feet long, 4 inches in diameter, and the horizontal wingspan (WS) of wing 14 is one-third of the length of the spar.

The preferred dihedral angle $\beta$ of wing 14 is 30°. I have found that this dihedral angle is critical in order to prevent spar 12 from rolling and yawing during tow. Because casing 36 and spar 12 are mounted well forward of the center of drag of wing 14, fore-and-aft stability is maintained and excessive pitching is avoided.

Figure 3:
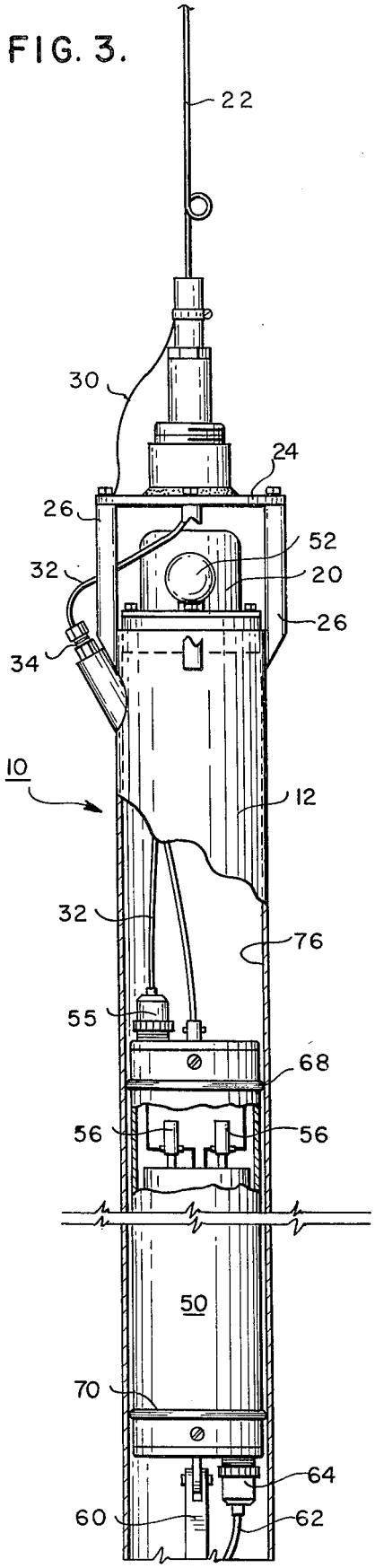
FIG. 3 is a cutaway view of the upper portion of the spar.
Figure 4:
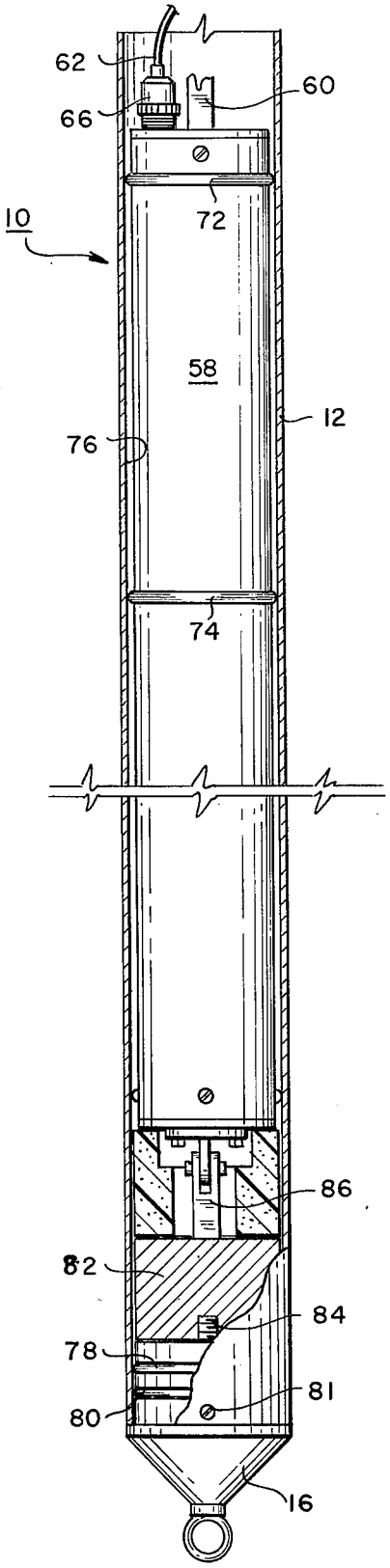
FIG. 4 is a cutaway view of the lower portion of the spar.

FIGS. 3 and 4 show cross-sectional views of the interior of the spar. A cylindrical container 50 encloses a radio transmitter (not shown) and the electronics (not shown) to operate Xenon flasher light 52 which is enclosed in waterproof housing 20. Radio signals from the transmitter are carried by lead 32 through plug 55. Container 50 also houses two mercury tilt switches 56. The switches cut off the flasher and the transmitter if and when spar 12 tilts more than about 60° from the vertical such as in very rough weather, or when buoy 10 is stored on deck in a horizontal position when not in use.

A lower cylindrical container 58 contains the batteries (not shown) to power the radio and flasher. Containers 50 and 58 are mechanically fastened together by a mating pin and clevis assembly 60. Power is transferred from the batteries in container 58 to the electronics in container 50 by multiconductor lead 62 through plugs 64 and 66. O-rings 68, 70, 72 and 74 cushion containers 50 and 58 against the inner wall 76 of spar 12.

The lower end of spar 12 is sealed against water invasion by end plug 16 and by O-rings 78 and 80. Plug 16 is secured in place by six screws 81 (only one is shown). A ballast weight 82 is screwed to a stud 84 in end plug 16. The weight of ballast 82 must be determined in relation to the weight of the batteries in container 58, (14 to 18 pounds is typical). Container 58 is secured to ballast weight 82 by a mating clevis and pin assembly 86 thereby preventing containers 50 and 58 from shifting within spar 12. Ballast is required to cause the buoy to float upright when stationary and at rest in the water.

Figures 5, 6:
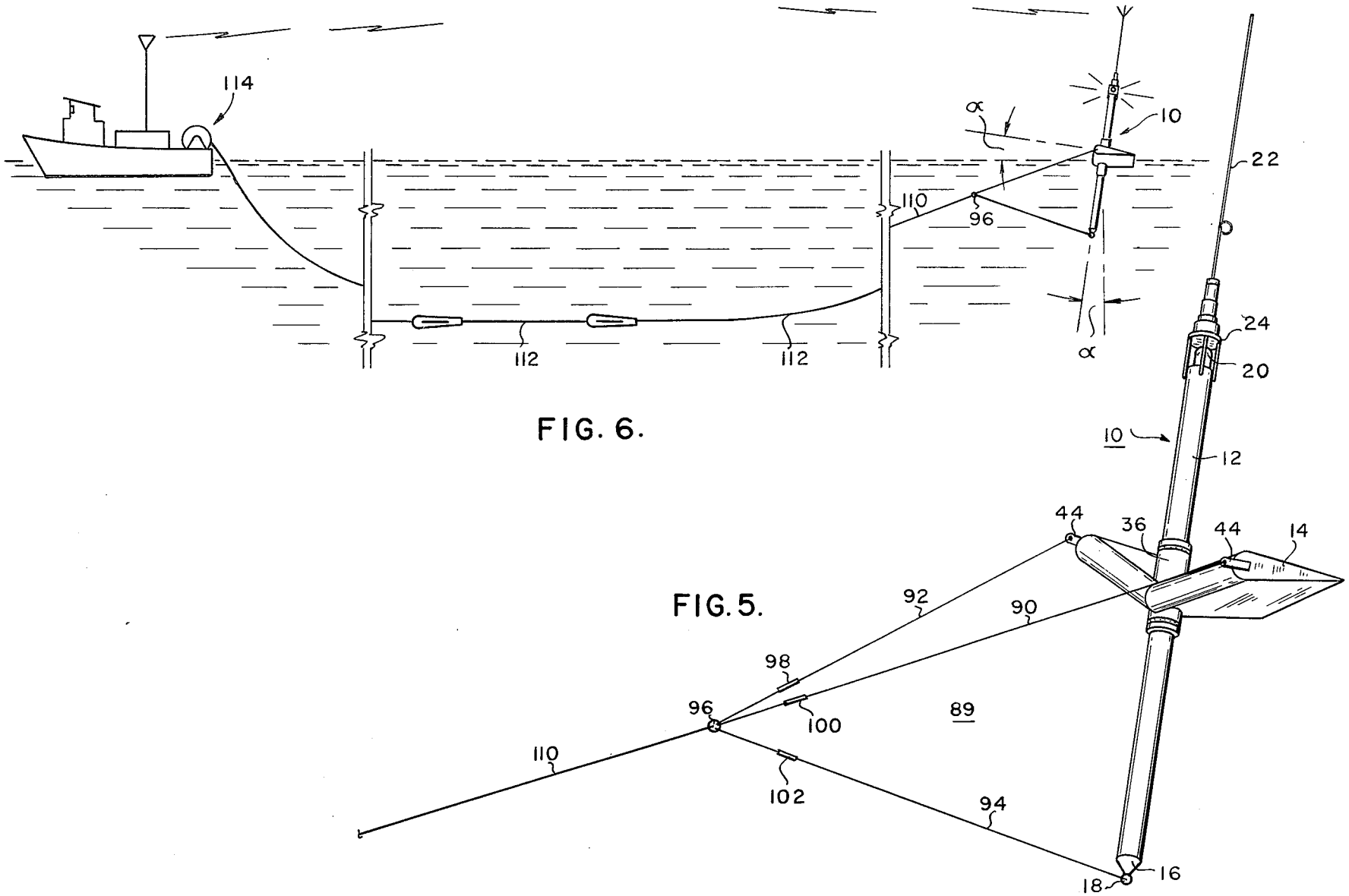
FIG. 5 illustrates the towing bridle attached to the tail buoy.
FIG. 6 shows the attitude of the buoy, towing bridle and towing line when the buoy is under tow.

Referring now to FIGS. 5 and 6, a towing bridle generally designated as 89, is attached to buoy 10. Towing bridle 89 consists of three lines 90, 92 and 94 which are attached to towing eyes 44 on each end of wing 14 and to towing eye 18 at the lower end of spar 12. The forward ends of the three tow lines are connected through swivels 98, 100, 102 to a tow ring 96. Bridle line 94 is shorter than lines 90 and 92, thereby causing wing 14 to assume a slightly nose-high attitude (positive attack angle $\alpha$) to the water surface. Angle $\alpha$ causes wing 14 to plane over the water surface in a desired attitude. The magnitude of angle $\alpha$ is best determined empirically for each buoy and is adjusted to cause wing 14 to generate a slight positive lift.

The design criteria for buoy 10 to make it stable under tow are critically dependent upon several factors: the location of wing 14 with respect to the center of gravity of spar 12, the dihedral angle $\alpha$, the attack angle of wing 14 with respect to the water surface, and the position of casing 36 with respect to the center of drag of wing 14.

The primary and essential function of wing 14 is to dynamically stabilize buoy 10 in the roll, pitch, and yaw axes (shown in FIGS. 1 and 2) while it is under tow. As is well known in buoy technology, a naked spar buoy is relatively insensitive to periodic wave motions of the water surface. Buoyant wing 14 therefore also serves a secondary purpose in that it constrains the spar to maintain an approximately fixed height above an undulating water level.

When towed, the apex line 37 of the V-wing is partially submerged as shown in FIGS. 1 and 2. If the spar rolls to one side, the forces against the low side of the wing become greater than the forces against the high side, thereby providing a righting moment. Similarly, the water streaming over the wing due to its motion in the direction of travel, provide restoring forces in the pitch axis. Due to the dihedral, the wing acts simultaneously as a horizontal stabilizer in the roll axis and as a rudder in the yaw axis.

In an illustrative operation one end of a rope or line 110, several hundred feet long, is tied to the two ring 96. The bridle lines are adjusted in length to provide the desired angle of attack between the wing and the water surface. The other end of line 110 is tied to the end of a seismic streamer cable 112 which is towed at a desired depth by seismic vessel 114. Since buoy 10 is well behind streamer 112, the buoy's slight towing noise transmitted to the hydrophones in streamer 112 is negligible. Mechanical shock and noise due to wave action on buoy 10 is absorbed by the inherent elasticity of rope 110. Under normal conditions, the deviation from the desired line of the trailing end of streamer 112 can be determined by radio bearings (or by radar bearings if buoy 10 is equipped with a radar reflector) or by visual sighting of the flasher. If the streamer 112 should become severed and lost from ship 114, the ship can home in on the radio transmissions of the buoy and recover the severed portion of the streamer.

What is claimed is:

1. A buoy adapted to be towed over the surface of a body of water comprising in combination: a spar, a streamlined, V-shaped wing means having a predetermined positive dihedral being coupled to and extending laterally from said spar, said wing means being positioned on said spar such that its apex is submerged in the body of water to dynamically stabilize said buoy in the pitch, roll and yaw axes while said buoy is under tow, and bridle means coupled to said spar and wing means for adjusting the angle of attack of said wing means with respect to the water surface.

2. A buoy adapted to be towed over the surface of a body of water comprising:

a hollow spar having upper and lower ends and a center of gravity;

a buoyant, streamlined wing having a positive dihedral angle and a horizontal wingspan, said wing being detachably secured to said spar, the vertical axis of said spar being disposed centrally with respect to the horizontal wingspan of said wing, forward of the center of drag of said wing, and perpendicularly with respect to the horizontal axes of said wing; and a ballast weight secured to the lower end of said spar, the mass and buoyancy of said spar, wing, and ballast being so disposed that the only stable orientation of the buoy at rest in the water is one in which the spar is substantially vertical with the upper end extending above the water surface.

3. The buoy of claim 1 wherein:

said bridle consists of two upper lines and a lower line, said upper lines being connected to the ends of the wing and said lower line being connected to the lower end of the spar, the length of said lower line being so adjusted as to cause the leading edge of the wing to tilt upwardly at a desired angle of attack, said wing thereby generating a positive lift during tow.

4. The buoy of claim 3 and including:

an instrument package includng signalling means; and a battery connected to and furnishing power for the instrument package.

5. The buoy of claim 4 wherein:

said signalling means includes a transmitter and antenna, said antenna being attached to the upper end of said spar, and said transmitter and battery being mounted interiorily of said hollow spar at the bottom thereof to provide at least a portion of said ballast weight.

6. The buoy of claim 5 wherein:

the dihedral angle is substantially 30° relative to the horizontal.

7. The buoy of claim 6, and tilt-switch means to turn off the power to the instrument package when the buoy is inclined to an undesired angle to the vertical, the tilt-switch means is biaxially sensitive and is adapted to turn off the battery power when the spar tilts substantially more than 60° from the vertical.

8. The buoy of claim 7 wherein:

the wingspan of said wing is one-third of the length of said spar.

9. The buoy of claim 8 wherein:

the apex of the dihedral angle is located above the center of gravity by the spar by a predetermined value to maintain said buoy in a vertical position when the buoy is at rest in the water.

* * * * *